US006450857B1

(12) United States Patent
Watanabe

(10) Patent No.: US 6,450,857 B1
(45) Date of Patent: Sep. 17, 2002

(54) FOUR-WHEEL DRIVE TOY

(75) Inventor: Hiroyuki Watanabe, Tokyo (JP)

(73) Assignee: Imagic, Inc., Tokyo (JP)

( * ) Notice: Subject to any disclaimer, the term of this patent is extended or adjusted under 35 U.S.C. 154(b) by 0 days.

(21) Appl. No.: 10/002,110

(22) Filed: Dec. 5, 2001

(30) Foreign Application Priority Data

Dec. 5, 2000 (JP) ..... 2000-008614

(51) Int. Cl.[7] ..... A63H 17/00

(52) U.S. Cl. ..... 446/465; 446/462; 446/463; 446/466

(58) Field of Search ..... 446/463, 462, 446/466, 437

(56) References Cited

U.S. PATENT DOCUMENTS 3,063,194 A * 11/1962 Berguerand
4,976,650 A * 12/1990 Watanabe ..... 446/418
5,273,478 A * 12/1993 Yamasaki ..... 446/409
6,206,751 B1 * 3/2001 Lee ..... 446/431

* cited by examiner

*Primary Examiner*—Derris H. Banks
*Assistant Examiner*—Ali Abdelwahed
(74) *Attorney, Agent, or Firm*—Swidler Berlin Shereff Friedman, LLP

(57) ABSTRACT

A four-wheel drive toy including a chassis, front wheels operably connected with the chassis, and rear wheels operably connected with the chassis. A flywheel is operably connected to the front wheels and the rear wheels and operable to drive the toy. A front wheel axle is operably connected to the chassis so as to vertically pivot relative to the chassis such that when driving over an uneven surface the front wheels and the rear wheels all contact the uneven surface, thereby ensuring that a driving force from the front wheels and the rear wheels is transmitted to the uneven surface and that the toy runs over the uneven surface.

2 Claims, 6 Drawing Sheets

FOUR-WHEEL DRIVE TOY

BACKGROUND OF THE INVENTION

1. Field of the Invention

The present invention relates to a four-wheel drive toy utilizing a flywheel, and particularly to a four-wheel drive toy which can energetically run over an uneven surface such as an irregular floor surface, gradient surface and obstacle.

2. Description of the Related Art

In a conventional four-wheel drive toy adapted to run using a flywheel, since both front wheel and rear wheel axles are fixed in parallel to each other, when trying to run over an irregular floor surface or an obstacle the four-wheel drive toy cannot contact the surface or obstacle on four wheels thereof but in many cases tends to run in a state in which the toy can contact the surface or obstacle only at two points on one of the front wheels and one of the rear wheels, and it has been difficult for the conventional four-wheel drive toy to run over the irregular floor surface or obstacle.

In order to solve this problem it has been required to develop a technology in which four wheels of a four-wheel drive toy can all come into contact with an irregular floor surface or an obstacle as in many cases as possible when the toy tries to run, over the surface or obstacle so that it is ensured that driving force is sufficiently transmitted to the surface or obstacle.

Then, the present invention was made in view of the aforesaid problem inherent in the prior art, and an object thereof is to provide a four-wheel drive toy adapted to run using a flywheel in which four wheels of the toy are all made to come into contact with an uneven surface such as an irregular floor surface, gradient surface and obstacle as much as possible as possible so that driving force from all the four wheels is transmitted to the uneven surface to thereby allow the toy to run over the uneven surface.

SUMMARY OF THE INVENTION

With a view to attaining the object, according to a first aspect of the invention, there is provided a four-wheel drive toy using a flywheel characterized in that a front wheel axle is mounted in such a manner as to swing vertically relative to a chassis so that front and rear wheels of the four-wheel drive toy are all made to easily come into contact with an uneven surface such as an irregular floor surface, gradient surface and obstacle when the four-wheel drive toy is driven to run over the uneven surface, whereby it is ensured that driving force from the respective wheels is transmitted to the uneven surface with which said front and rear wheels of said four-wheel drive toy are in contact, thereby allowing the four-wheel drive toy to run over the uneven surface.

According to the first aspect of the invention, since the front wheel axle is mounted in such a manner as to swing vertically relative to the chassis of the four-wheel drive toy, for example, when the left front wheel rides on an obstacle the front wheel axle is allowed to automatically twist so that the right front wheel is prevented from being lifted up away from the surface with which it has been in contact, whereby the four wheels are allowed to still keep in contact with the surface with which the respective wheels are in contact and the driving force from all the four wheels is transmitted to the obstacle, thereby allowing a main body of the toy to run over the obstacle.

According to a second aspect of the present invention, there is provided a four-wheel drive toy as set forth in the first aspect of the invention, wherein the front wheel axle is not only mounted transversely in notched portions in the chassis but also passed through a swing shaft for the front wheels, and wherein a projection provided at a distal end of the front wheel swing shaft is fittingly inserted into a hole opened in a front end surface of the chassis, whereas a distal end of a transmission shaft for transmitting driving force from the flywheel is fittingly inserted into a rear end of the swing shaft.

According to the second aspect of the present invention, since the front wheel axle is transversely mounted in the notched portions in the chassis, the front wheels are allowed to swing vertically. Then, in this toy driving force from the flywheel is designed to be transmitted from the rear wheels to the front wheels, and even with the four-wheel drive mechanism since the front wheel axle is allowed to swing vertically by way of the front wheel swing shaft, when the toy main body tries to run over the uneven surface such as an irregular floor surface, gradient surface and obstacle the toy main body can run over the uneven surface while the four wheels are kept in contact with the surface with which the respective wheels have been in contact.

The present invention relates to a four-wheel drive toy using a flywheel. Namely, in the construction thereof a front wheel axle is mounted in such a manner as to swing vertically relative to a chassis so that front and rear wheels are all made to easily come into contact with an uneven surface such as an irregular floor surface, gradient surface and obstacle when the four-wheel drive toy tries to run over the uneven surface, whereby it is ensured that the driving force from the respective wheels is transmitted to the surface with which the respective wheels are in contact, thereby allowing the four-wheel drive toy to vigorously run over the uneven surface.

BRIEF DESCRIPTION OF THE DRAWINGS

The invention will be better understood from reading the description which will follow, which is given merely by way of example and made with reference to the appended drawings, in which.

DESCRIPTION OF THE PREFERRED EMBODIMENT

An embodiment of the present invention will be described in detail below with reference to the appended drawings.

Figure 1:
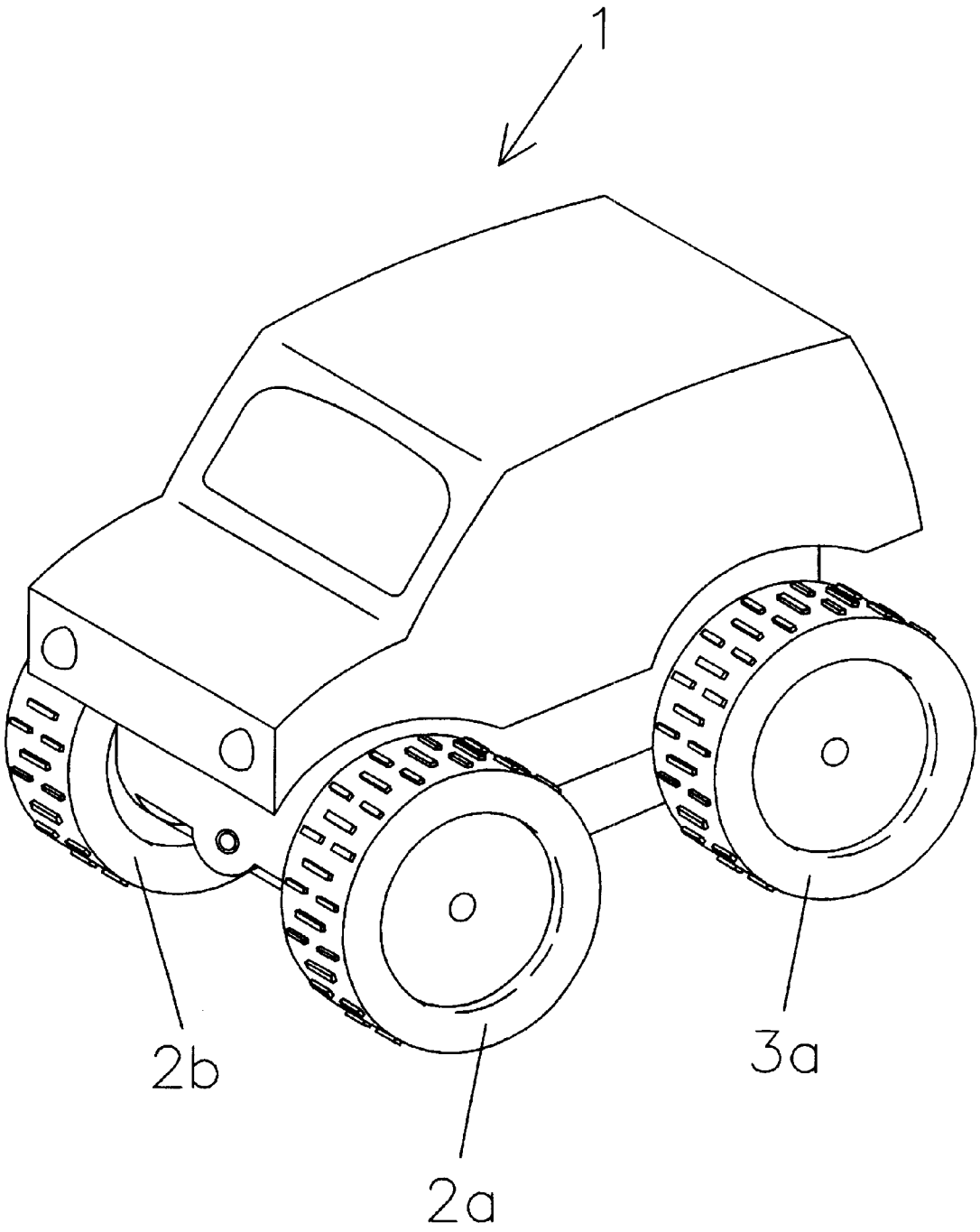
FIG. 1 is an external view of a four-wheel drive toy using a flywheel according to the present invention.
Figure 2:
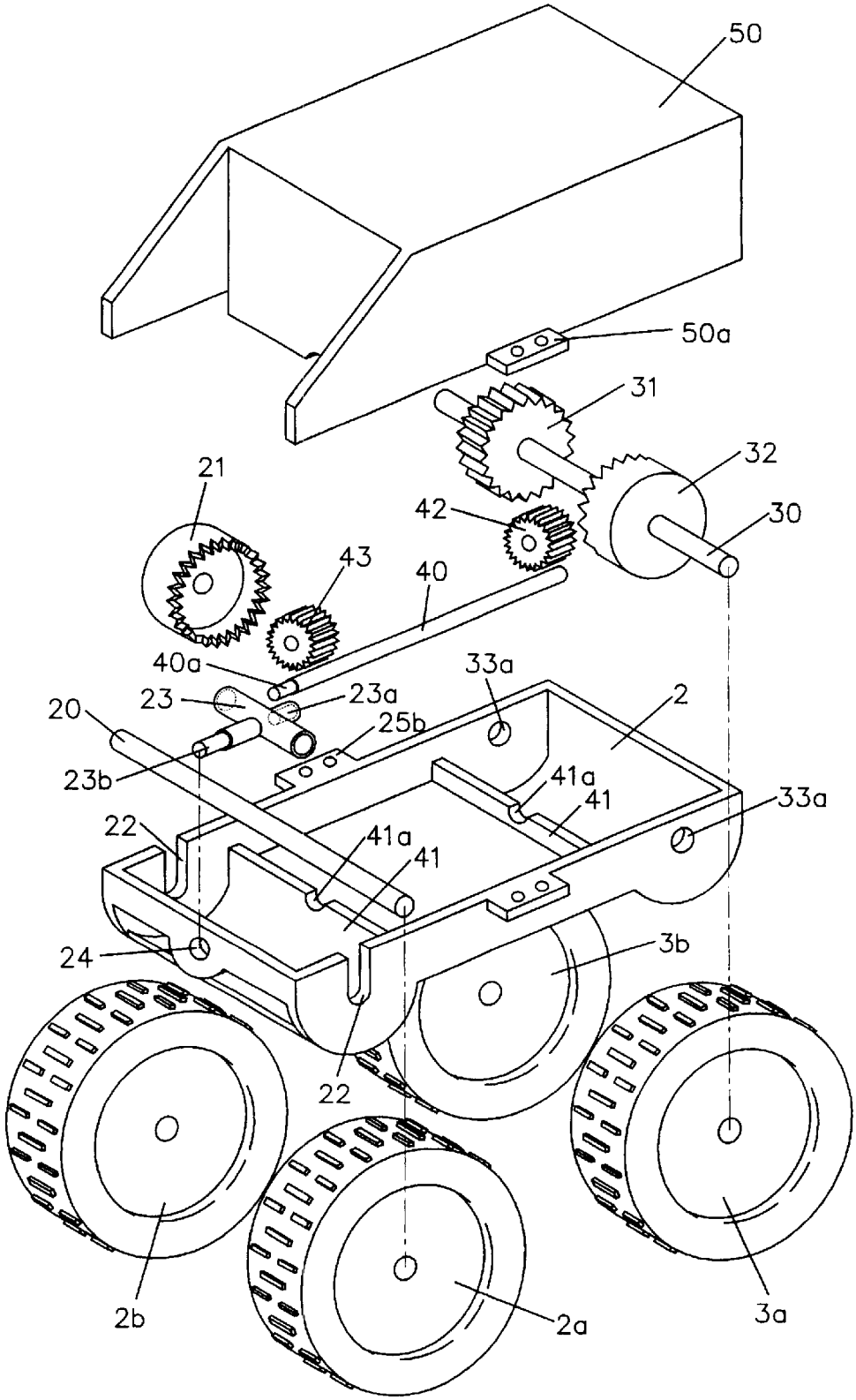
FIG. 2 is an exploded perspective view of the four-wheel drive toy according to the present invention with a body being removed.

FIG. 1 is a view showing an external appearance of a four-wheel toy using a flywheel according to the present invention, and FIG. 2 is an exploded perspective view of the four-wheel drive toy according to the invention with a body thereby being removed. In addition, FIG. 3 is a view illustrating a state in which components described as being exploded in FIG. 2 are assembled together, and FIG. 4 is a plan view of FIG. 3.

Figure 3:
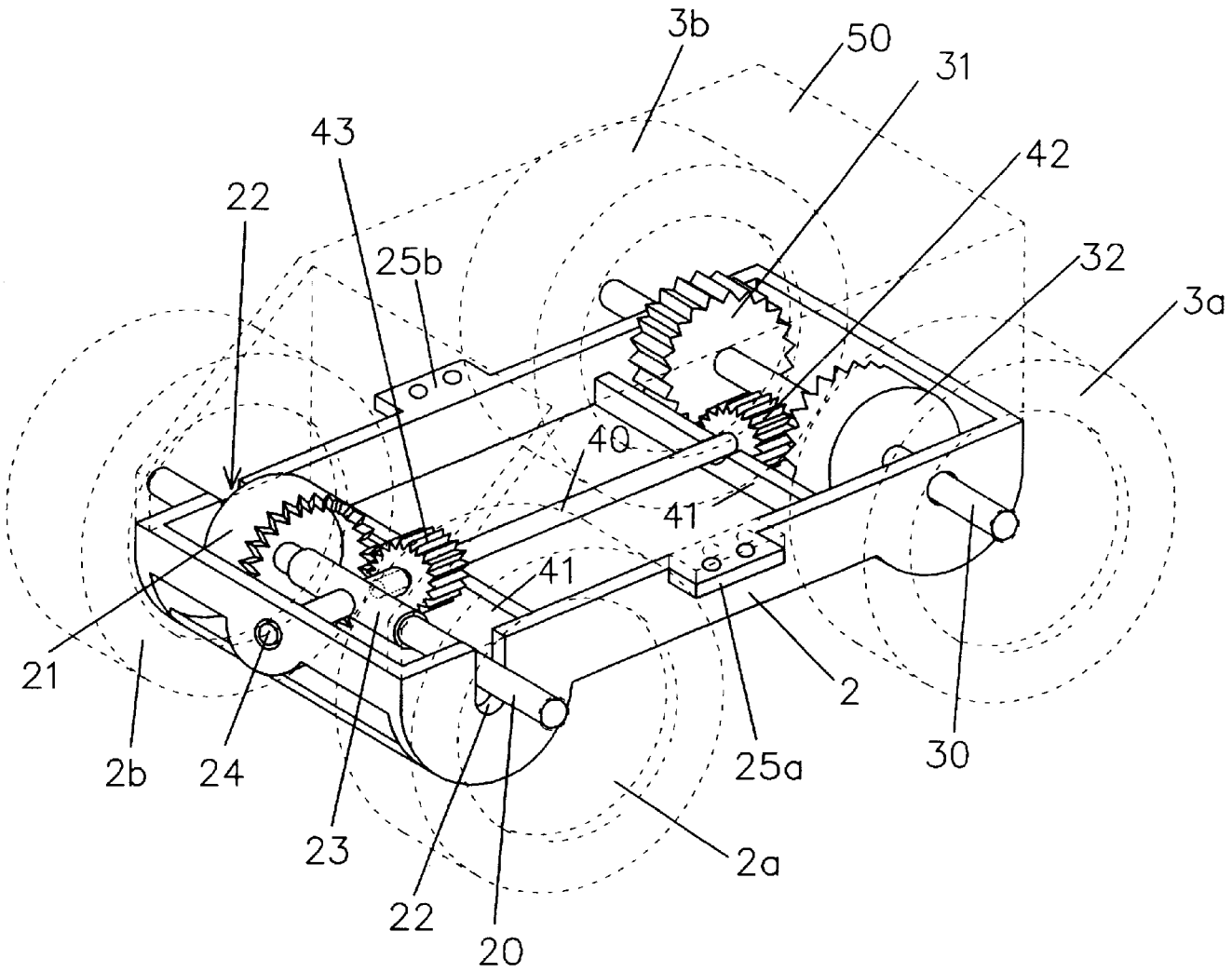
FIG. 3 is a view showing a state in which exploded components shown in FIG. 2 are assembled together.
Figure 4:
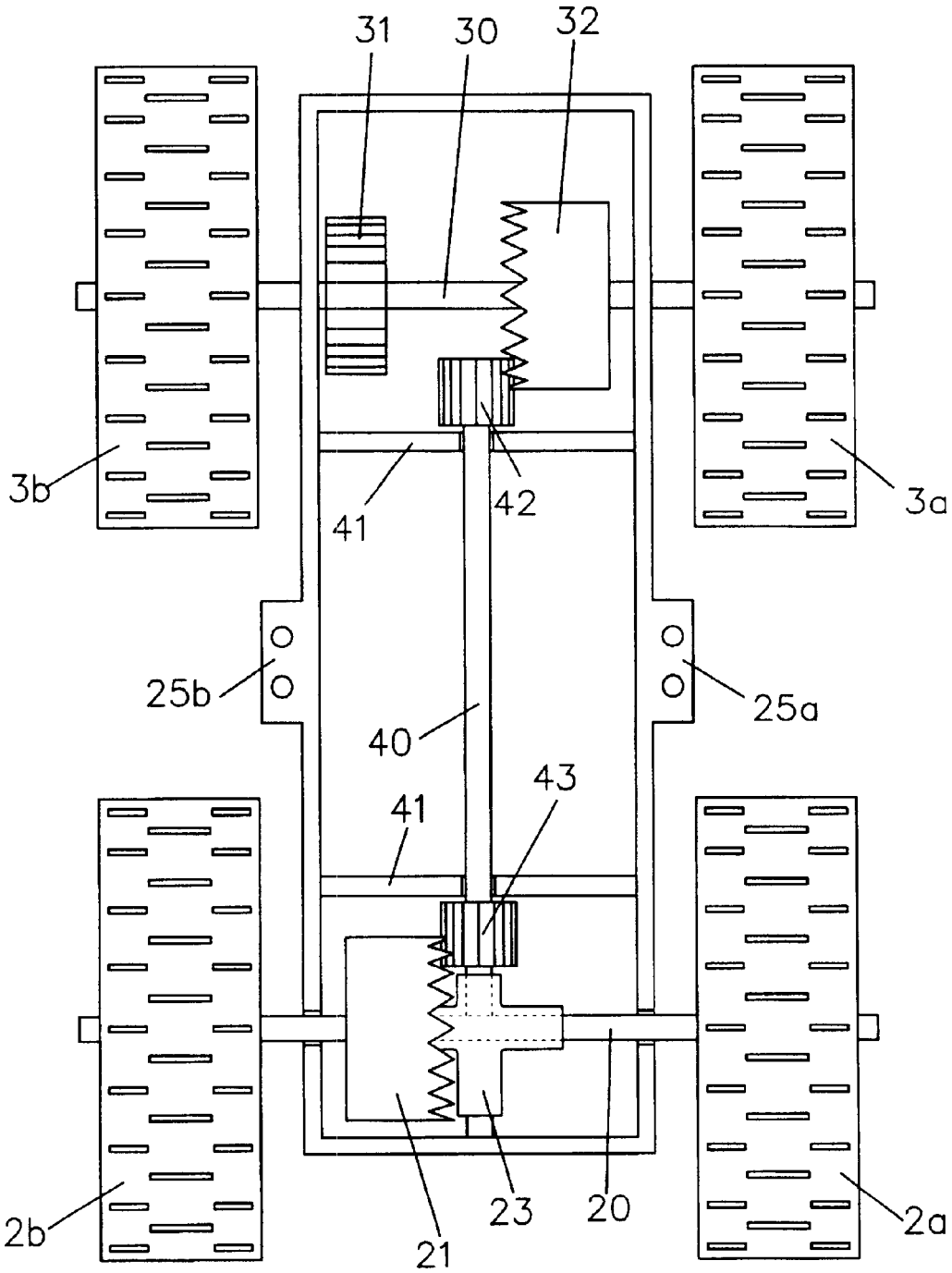
FIG. 4 is a plan view of FIG. 3.

As shown in FIGS. 2 to 4, two axles are mounted on a chassis 2. A front wheel axle 20 to which a crown gear 21 is attached is transversely mounted in notched portions 22, 22 formed in both side portions of the chassis 2, and a left front wheel 2*a* and a right front wheel 2*b* are fixed to respective ends of the axle 20. On the other hand, a rear wheel axle 30 to which a gear 31 and a crown gear 32 are attached is passed through axle holes 33*a*, 33*a* opened in the chassis 2, and a left rear wheel 3*a* and a right rear wheel 3*b* are fixed to respective ends of the axle 30. In addition, a connecting gear shaft 40 for connecting the front wheels with the rear wheels is a transmission shaft for transmitting driving force of the rear wheels to the front wheels and is horizontally mounted in notched portions 41*a*, 41*a* formed in ribs 41 provided inside the chassis 2 with pinions 42, 43 being attached to ends thereof. The pinion 42 meshes with the crown gear 32, whereas the pinion 43 meshes with the crown gear 21. A distal end 40*a* of the connecting gear shaft 40 protrudes from the pinion 43 and is fittingly inserted into an opening 23*a* formed in a rear end of a front wheel swing shaft 23 provided coaxially with the connecting gear shaft.

According to the construction, when the four-wheel toy is made to run forward with the four wheels of the four-wheel toy being in contact with a running surface, rotational force of the crown gear 32 is transmitted to the pinion 42 on the rear wheel side, whereas on the front wheel side rotational force of the pinion 43 is transmitted to the crown gear 21.

Figure 5:
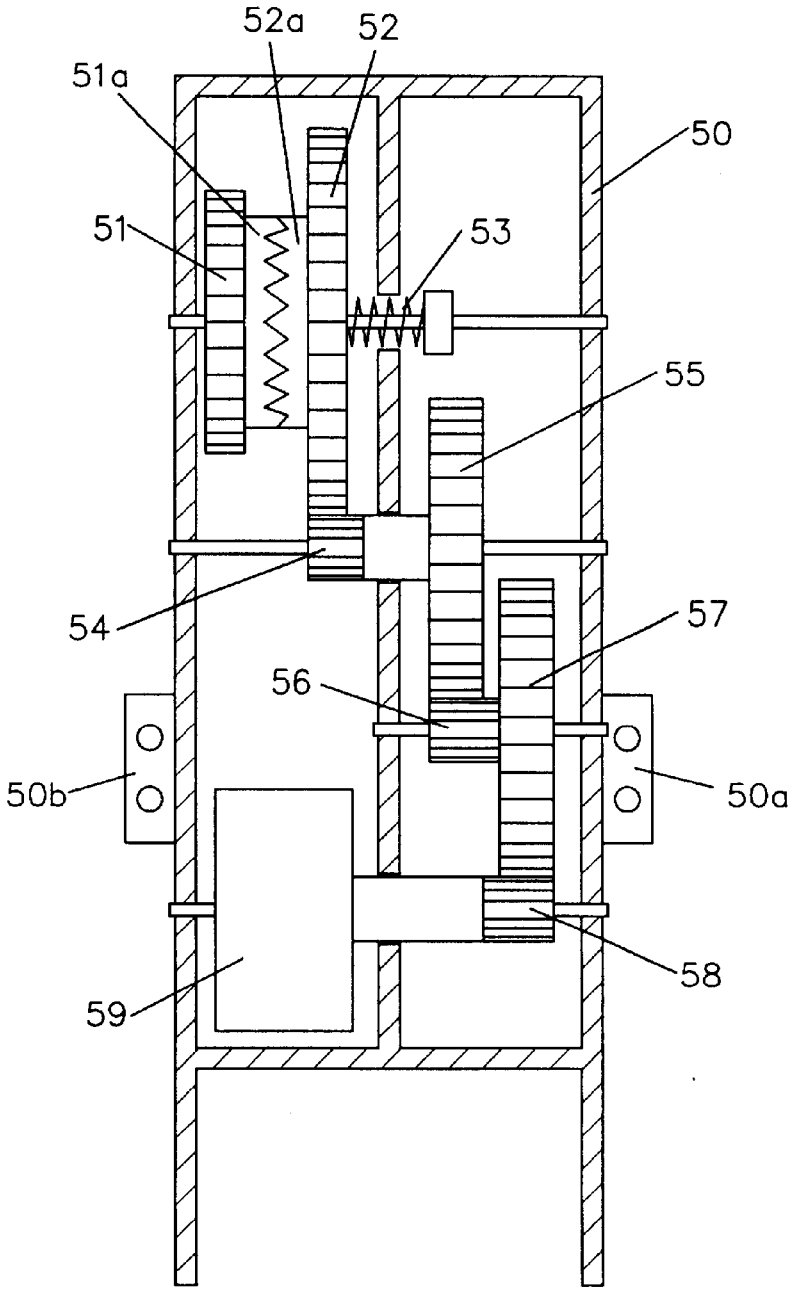
FIG. 5 is a horizontal cross-sectional view showing the internal construction of a drive unit for use with the present invention.

Next, a drive unit according to the present invention will be described with reference to FIGS. 2 and 5. FIG. 5 is a cross-sectional plan view showing the internal construction of the drive unit, in which reference numerals 51 and 52 denote to a clutch mechanism, and a spur wheel 52 is normally pressed by a spring 53. According to this construction, when a flywheel is suddenly accelerated with a certain load being applied to the spur wheel 52, the meshing engagement between a running face ratchet 51*a* and a running face ratchet 52*a* is released, whereby the spur wheel 52 is pressed outwardly against the spring 53 so as to suppress the rotation of the spur wheel 51. In addition, similarly, when a certain load is applied to the spur wheel 51 by stopping the wheels while the four-wheel drive toy is running by the flywheel this clutch mechanism is actuated to prevent a damage to the spur wheels or the like. The spur wheel 52 meshes with a pinion 54, a spur wheel 55 attached to the same shaft to which the pinion 54 is attached meshes with another pinion 56, and a spur wheel 57 attached to the same shaft to which the pinion is attached meshes with a further pinion. A flywheel 59 is provided on the same shaft to which the pinion 58 is attached, and rotational force from a spur wheel 52 is transmitted to the spur wheel 51, whereby the speed of the rotational force so transmitted is then increased through a series of groups of gears described above for transmission to the flywheel. Note that collar portions 50*a*, 50*b* of the drive unit 50 are screwed to collar portions 25*a*, 25*b* of the chassis 2.

Figure 6:
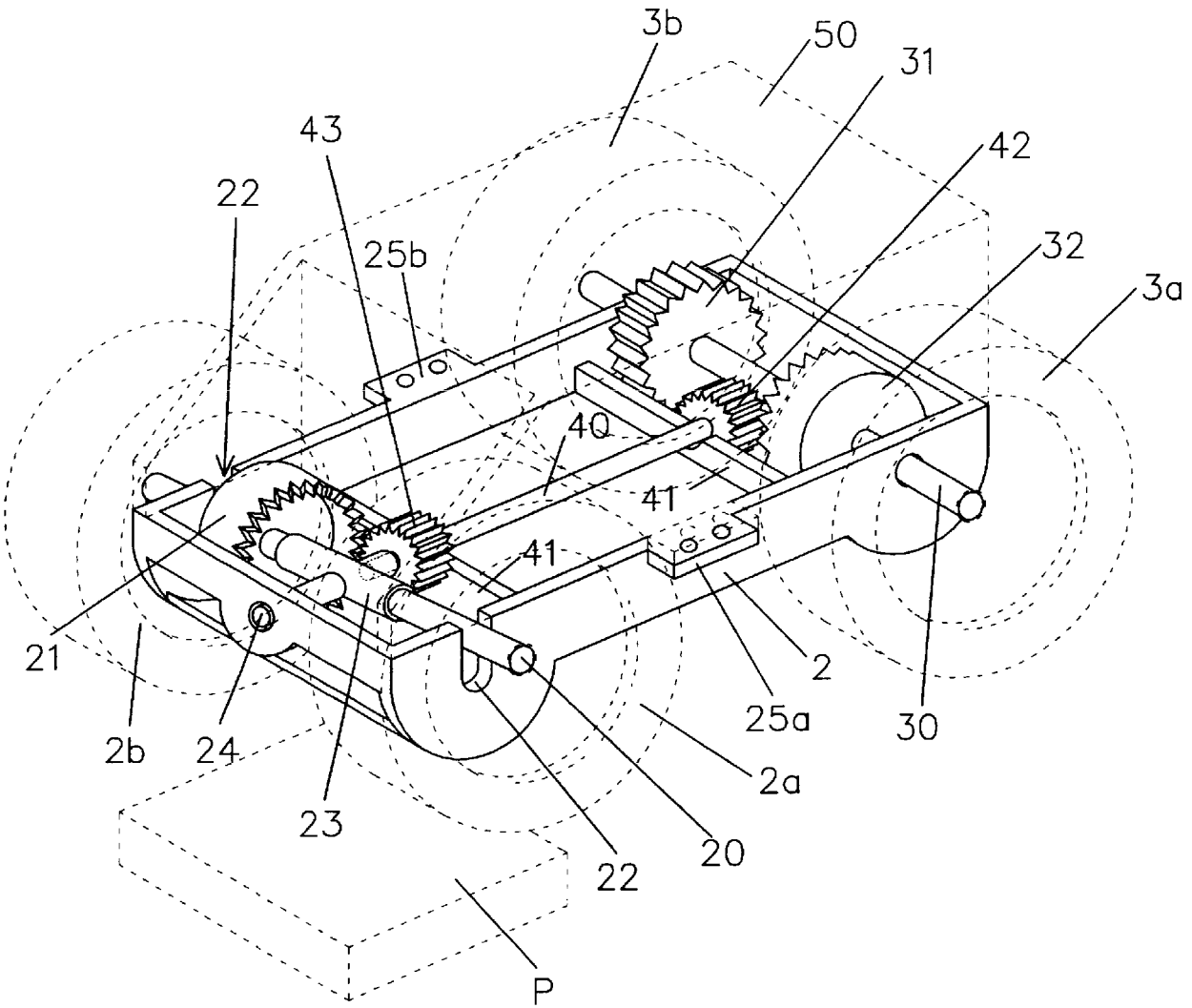
FIG. 6 is a view illustrating a state in which the four-wheel drive toy according to the present invention is in operation.

FIG. 6 is a view showing a state in which the four-wheel drive toy according to the present invention is in operation.

As shown in FIG. 6, when the left front wheel 2*a* of the four-wheel drive toy 1 runs over an obstacle P the left end side of the axle is lifted up from a horizontal state shown in FIG. 3 about a point denoted by reference numeral 24 acting as a fulcrum whereby the front wheel axle 20 tilts toward the right front wheel 2*b*. This allows all the four wheels to stay in contact with the surface with which they are in contact even when the left front wheel 2*a* is lifted up. On the contrary, when the right end of the axle 20 is lifted up the axle tilts toward the left front wheel 2*a* side, and similarly, all the four wheels are allowed to stay in contact with the surface with which they are in contact, whereby the four-wheel drive toy can run over the obstacle P vigorously.

While the embodiment describes the example in which the flywheel is disposed on the front wheel side, the location of the flywheel is not limited to the front wheel side but the flywheel may be disposed on the rear wheel side. In addition, while the example illustrates the example in which the four-wheel drive toy is driven forward, the four-wheel toy can run over an obstacle while being driven backward.

The present invention is effected in the mode that has been described heretofore and provides the following advantages.

According to the present invention, since the front wheel axle is mounted in such a manner as to swing vertically relative to the chassis, all the four wheels of the toy are made to easily come into contact with the uneven surface such as an irregular floor surface, gradient surface and obstacle, whereby it is ensured that the driving force from all the four wheels is transmitted to the uneven surface, thereby allowing the four-wheel drive toy to run over the uneven surface.

What is claimed is:

1. A four-wheel drive toy, comprising:

a chassis;

front wheels operably connected with the chassis;

rear wheels operably connected with the chassis;

a flywheel operably connected to the front wheels and the rear wheels and operable to drive the toy;

a front wheel axle operably connected to the chassis so as to vertically pivot relative to the chassis such that when driving over an uneven surface the front wheels and the rear wheels all contact the uneven surface, thereby ensuring that a driving force from the front wheels and the rear wheels is transmitted to the uneven surface and that the toy runs over the uneven surface;

a swing shaft operable to receive the front wheel axle and comprising a distal projection, wherein a front end of the chassis comprises a swing shaft receiving passage for receiving the distal projection; and a transmission shaft operable to transmit driving force form the flywheel, wherein a distal end of the transmission shaft is inserted into a rear end of the swing shaft, wherein the chassis comprises notched portions in which the front wheel axle is transversely mounted.

2. The four-wheel drive toy according to claim 1, wherein the uneven surface comprises an irregular floor surface, a gradient surface, or an obstacle.

* * * * *